US009966696B2

(12) United States Patent
Cheng

(10) Patent No.: US 9,966,696 B2
(45) Date of Patent: May 8, 2018

(54) TWO CONNECTOR ASSEMBLIES COUPLED TO EACH OTHER AND AN ELASTIC CONDUCTIVE METAL SHEET CONNECTED TO A RECEPTACLE TUBE CONTAINING ONE OF THE ASSEMBLIES

(71) Applicant: Huidong Songyi Manufactory Co. Ltd., Huizhou (CN)

(72) Inventor: Kin Ming Cheng, Hong Kong (HK)

(73) Assignee: HUIDONG SONGYI MANUFACTORY CO. LTD., Huizhou (CN)

( * ) Notice: Subject to any disclaimer, the term of this patent is extended or adjusted under 35 U.S.C. 154(b) by 0 days. days.

(21) Appl. No.: 15/626,037

(22) Filed: Jun. 16, 2017

(65) Prior Publication Data

US 2018/0090880 A1 Mar. 29, 2018

Related U.S. Application Data

(63) Continuation-in-part of application No. 15/347,804, filed on Nov. 10, 2016, now Pat. No. 9,716,360.

(30) Foreign Application Priority Data

Sep. 29, 2016 (CN) ..... 2016 2 1091022 U

(51) Int. Cl.
*H01R 13/648* (2006.01)
*H01R 13/627* (2006.01)
(Continued)

(52) U.S. Cl.
CPC ..... *H01R 13/6275* (2013.01); *H01R 13/652* (2013.01); *H01R 33/02* (2013.01)

(58) Field of Classification Search
CPC ..... H01R 13/60; H01R 13/66; H01R 13/73; H01R 13/629; H01R 13/648;
(Continued)

(56) References Cited

U.S. PATENT DOCUMENTS 3,118,618 A * 1/1964 Holbrook ..... F21S 4/10 362/123
3,619,598 A * 11/1971 Hermanson ..... A47G 33/0836 362/122

(Continued)

*Primary Examiner* — Chandrika Prasad
(74) *Attorney, Agent, or Firm* — Hemisphere Law, PLLC; Zhigang Ma

(57) ABSTRACT

The present invention provides an electric connector including a male and a female connectors used for being mounted in ends of trunk portions of an artificial tree. The male connector includes a plug tube, and a first electrical connector assembly. The female connector includes a receptacle tube, a second electrical connector assembly and an elastic conductive metal sheet attached to an outside surface of the receptacle tube and having an arch part inserted in the receptacle tube through a fixing hole. A first end of the plug tube includes an external flange. When the first end of the plug tube is inserted in the receptacle tube with the flange being clamped tightly between the receptacle tube and the second support, the first electrical connector assembly is electrically coupled to the second electrical connector assembly, and the trunk portions can also be electrically connected and be grounded.

20 Claims, 5 Drawing Sheets

(51) Int. Cl.
*H01R 33/02* (2006.01)
*H01R 13/652* (2006.01)

(58) Field of Classification Search
CPC .. H01R 13/652; H01R 13/6275; H01R 24/54; H01R 25/00; H01R 31/06; H01R 33/02; H01R 33/20; H01R 33/94
USPC ..... 439/108, 345, 529, 638; 362/122–123; 315/185–186
See application file for complete search history.

(56) References Cited

U.S. PATENT DOCUMENTS 6,357,102 B1 * 3/2002 Benner ..... A61C 15/043 29/430
7,955,125 B1 * 6/2011 Petrillo ..... H01R 9/24 439/535
8,388,383 B2 * 3/2013 Tsai ..... H01R 24/28 439/628
8,454,187 B2 * 6/2013 Chen ..... F21V 21/002 362/122
8,569,960 B2 * 10/2013 Chen ..... A47G 33/06 315/185 R
9,222,656 B2 * 12/2015 Chen ..... A47G 33/06
9,362,657 B1 * 6/2016 Yang ..... A47G 33/12
9,716,360 B1 * 7/2017 Cheng ..... H01R 13/60

* cited by examiner

TWO CONNECTOR ASSEMBLIES COUPLED TO EACH OTHER AND AN ELASTIC CONDUCTIVE METAL SHEET CONNECTED TO A RECEPTACLE TUBE CONTAINING ONE OF THE ASSEMBLIES

CROSS-REFERENCE TO RELATED APPLICATIONS

The present application is a continuation-in-part of U.S. patent application Ser. No. 15/347,804, filed Nov. 10, 2016, which claims the benefit of CN Utility Patent Application No. 201621091022.4, filed Sep. 29, 2016, all of which are incorporated herein by reference in their entireties.

BACKGROUND OF THE INVENTION

1. Field of the Invention

The present invention relates to electric connectors, and specifically relates to an electric connector used on an artificial tree, an artificial Christmas tree for example.

2. Description of Related Art

Artificial trees are commonly used in holiday decoration, or commercial square decoration, and roadside decoration. Typically, an artificial tree is illuminated by light strings and decorated with decorations, such as figurines of airplanes, bicycles, space rockets, etc.

To easy the interconnection of the artificial tree, an artificial tree generally includes two or three sections of hollow trunks, many branches extending out from each section of trunks, electric wires extending within the hollow trunks, and many light strings distributed about the exterior of the tree and electrically connected with the electric wires.

Electric connectors are utilized to avoid wiring troubles induced by long wires. The electric wires are inserted into the trunks from the bottom of the tree and through the trunks to the outside of the trunks. Then the electric wires are connected to the next wires by one or one more electric connectors. Each electric connector has a male connector and a female connector, the male connector is fixed within one of the sections of trunks, and the female connector is fixed within another one of the sections of trunks. When adjacent sections of trunks are connected together, the corresponding electric connector(s) is(are) electrically connected. Thus it is easy and convenient to link the electric wires from the bottom to the top of the artificial tree by the electric connectors.

For example, U.S. Pat. No. 9,362,657 to Yang filed Feb. 13, 2015 and entitled "Quick Mount Connector Assembly of Artificial Christmas Tree" discloses a male connector and a female connector detachably connected to the male connector. The quick mount connector assembly of Yang can easily and conveniently link the electric wires from the bottom to the top of the artificial tree. However, a structure of the connector assembly is complicated and hard to manufacture and assembly, and clamping pins are needed to passing through through holes 13A, 13B secure the connector assembly to the trunks of the artificial trees.

Therefore, there is a need to provide an improved electric connector used on an artificial tree.

BRIEF DESCRIPTION OF THE SEVERAL VIEWS OF THE DRAWING(S)

The foregoing and other exemplary purposes, aspects and advantages of the present invention will be better understood in principle from the following detailed description of one or more exemplary embodiments of the invention with reference to the drawings, in which.

DETAILED DESCRIPTION OF THE INVENTION

The invention will now be described in detail through several embodiments with reference to the accompanying drawings.

An electric connector is used on an artificial tree which preferably includes two or three or four tree portions which are capable of being aligned along an axis and fixed to and supported by a base. For convenience of description, a vertical axis is defined, and the two or three or four tree portions are aligned along the vertical axis in practice. Each tree portion preferably includes a trunk portion and many branches extending outwardly from an outside wall of the trunk portion. The trunk portion is preferably cylindrical and hollow and having a lower end (closer to ground with reference to the vertical axis) and an upper end (further away from ground with reference to the vertical axis). The lower end of each trunk portion may be sized to fit into the upper end of an adjacent tree portion or the base, such that adjacent tree portions are mechanically connected together.

Figure 1:
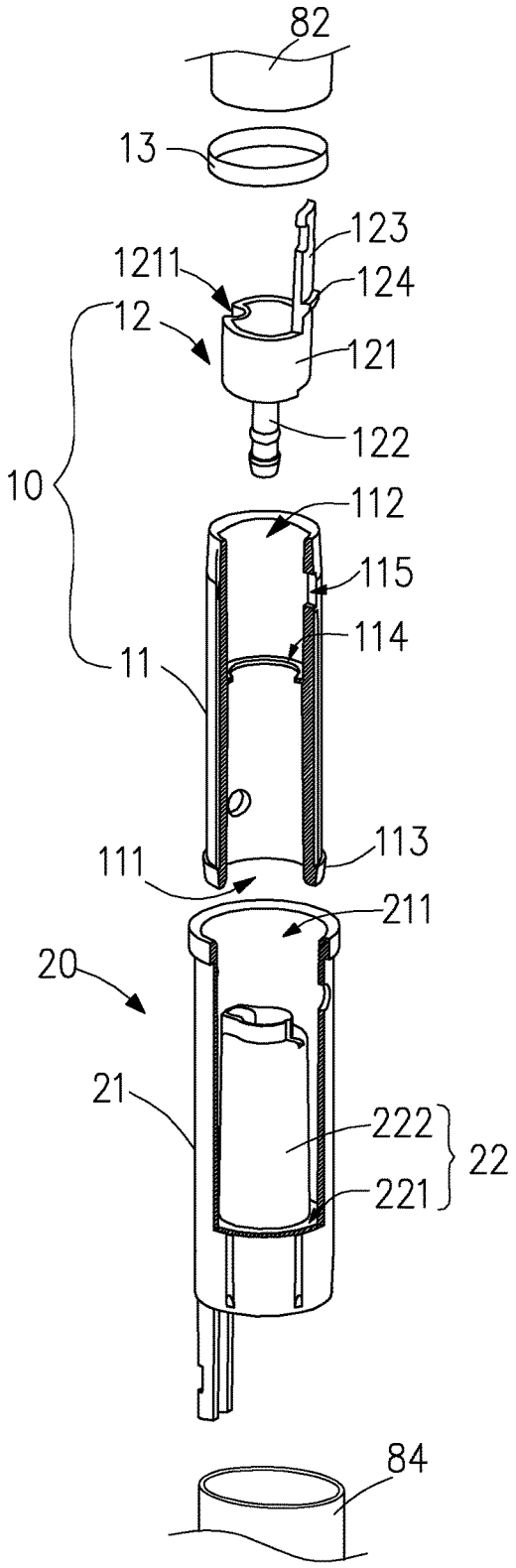
FIG. 1 is an exploded view illustrating supporting assemblies of an electric connector in accordance with an embodiment of the invention.
Figure 2:
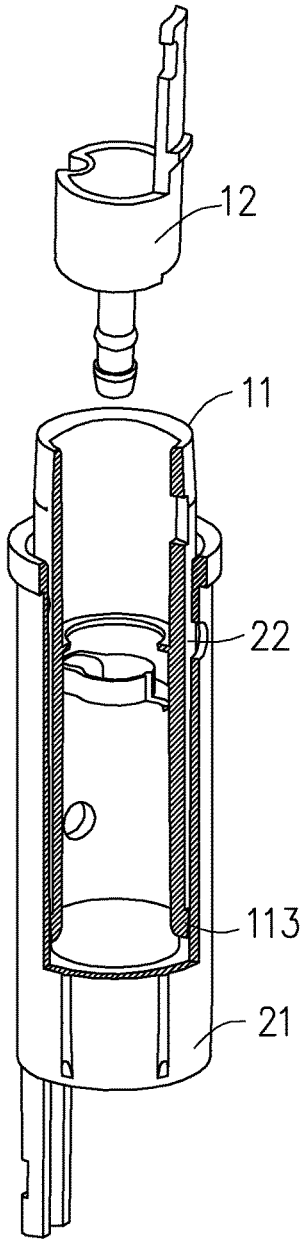
FIG. 2 is an exploded view illustrating the supporting assemblies of the electric connector with a plug tube inserted in a receptacle tube.
Figure 3:
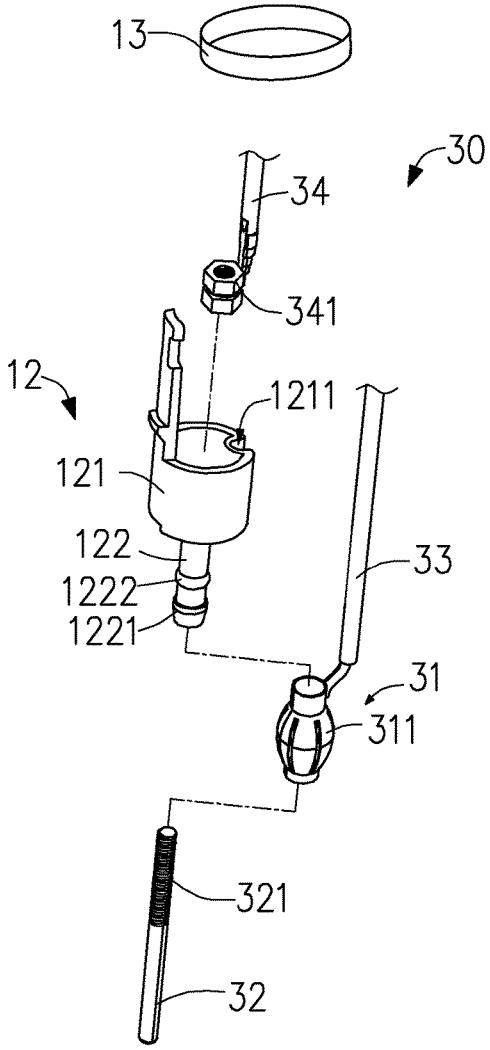
FIG. 3 is an exploded view illustrating a first support and a first electrical connector assembly.

The electric connector includes a male connector mounted in (inserted into) the lower end of the trunk portion (labeled by 82 in FIG. 1) of one of the tree portions and a female connector mounted in (inserted into) the upper end of the trunk portion (labeled by 84 in FIG. 1) of another one of the tree portions or mounted in the base. When the two tree portions 82, 84 are aligned and connected together or when the tree portion 82 is connected to the base, the male connector and the female connector are mechanically connected and electrically coupled.

Please referring to FIG. 1 to FIG. 4, a male connector and a female connector are illustrated in accordance with an embodiment of the invention. The male connector includes a supporting assembly 10 and a first electrical connector assembly 30. The female connector includes a supporting assembly 20, a second electrical connector assembly 40, an elastic conductive metal sheet 50 (FIG. 4), and an electrical conductive metal ring 13.

The supporting assembly 10 of the male connector includes a plug tube 11 and a first support 12 received in the plug tube 11. The plug tube 11 has a cylindrical structure, and defines an opening 111 at its first end (lower end) and another opening 112 at its second end (upper end) opposite to its first end. The ring 13 is sleeved on the plug tube 11, and the second end of the plug tube 11 is received in the trunk portion 82 and is held by the inner wall of the trunk portion of the artificial tree. A flange 113 extends outwardly from the first end of the plug tube 11, when the ring 13 and a lower end of the trunk portion 82 is sleeved on the plug tube 11, the flange 113 protrudes out of the ring 13 and the lower end of the trunk portion 82. Preferably, an outer surface of the flange 113 and the outer surface of ring 13 abut, and the outer surface of ring 13 and the outer surface of the lower end of the trunk portion 82 abut, and an outer diameter of the flange 113, the ring 13 and the outer diameter of the lower end of the trunk portion 82 are substantially the same. An upper end of the ring 13 contact with and is electrically connected to the end of the trunk portion 82.

An internal flange 114 extends inwardly from a tube wall (inner wall) of the plug tube 11. The internal flange 114 divides an inner space of the plug tube 11 to a first receiving space and a second receiving space. The first support 12 includes a cylinder cup 121 with an upward opening and a mounting tube 122 extending downwardly from a bottom of the cylinder cup 121. A through hole (not shown) is defined in the bottom of the cylinder cup 121 and communicates with a through hole throughout the mounting tube 122. The cylinder cup 121 is received in the first receiving space, supported by the internal flange 114, and is sized to fit into an upper inner portion (defining the first receiving space) of the plug tube 11, thus a transverse movement of the cylinder cup 121 is prevented by the plug tube 11 and a lowest position of the cylinder cup 121 in the plug tube 11 is limited by the internal flange 114. The mounting tube 122 passes through a center opening defined by the internal flange 114 and extends downwardly into an lower inner portion (defining the second receiving space) of the plug tube 11.

Further more, a line slot 1211 extending along the vertical direction is defined in the outside wall of the cylinder cup 121. A fixing plate 123 extends upwardly from an upper edge of the cylinder cup 121, and a protrude 124 protrudes towards the inner wall of the plug tube 11 from the fixing plate 123. An opening 115 corresponds to and is configured for receiving the protrude 124 is defined in the tube wall of the plug tube 11. When the first support 12 is inserted in the plug tube 11, the protrude 124 can be locked in the opening 115, thus a vertical movement of the first support is prevented.

The first electrical connector assembly 30 is mounted on the first support 12 and includes a first electric conducting ring 31 electrically connected to a first electric wire 33 and a first electric conducting rod 32 with one end electrically connected to a second electric wire 34. At least a part of the ring 31 is sleeved on the mounting tube 122, and at least a flange 1221 (and/or flange 1222) protruding out from the mounting tube 122 for preventing the ring 31 from being released from the mounting tube 122 easily.

Furthermore, a middle part of the first electric conducting ring 31 is resilient and expanded with respect to its two ends. In the embodiment, several convex ribs 311 extending substantially in vertical direction and project outwardly in a radial direction to make the ring 31 resilient and expanded in the middle. In other embodiments, the middle part of the ring 31 may includes several salient points or rings.

A part (an end) of the first electric conducting rod 32 has external thread 321. The second electric wire 34 is electrically connected to one or two nuts 341 which are screwed with the external thread 321 of the first electric conducting rod 32. The other end of the first electric conducting rod 32 passes through the mounting tube 122 from the cylinder cup side and exposed out of the mounting tube 122 and the first electric conducting ring 31.

Understandably, the first electric conducting rod 32 may be sized to fit within the mounting tube 122 and a transverse movement is restricted. Furthermore, the mounting tube 122 may have internal thread to be screwed with the external thread 321 of the first electric conducting rod 32, thus a vertical movement of the rod 32 is also restricted.

As submitted above, the female connector includes the supporting assembly 20, the second electrical connector assembly 40 and the elastic conductive metal sheet 50. The supporting assembly 20 includes a receptacle tube 21 defining an opening 211 at its first end (upper end), and a second support 22 received in the receptacle tube 21. The receptacle tube 21 has a cylindrical structure and is sized to fit into the corresponding trunk portion 84.

Figure 5:
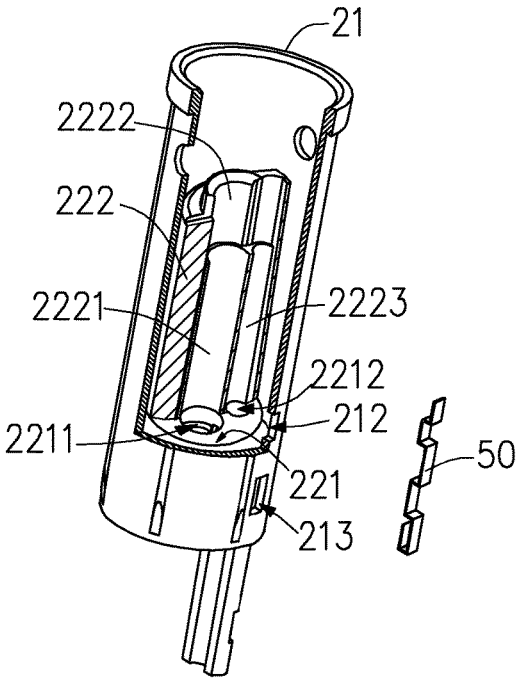
FIG. 5 is a partial cross-sectional view of the receptacle tube and the second support.
Figure 6:
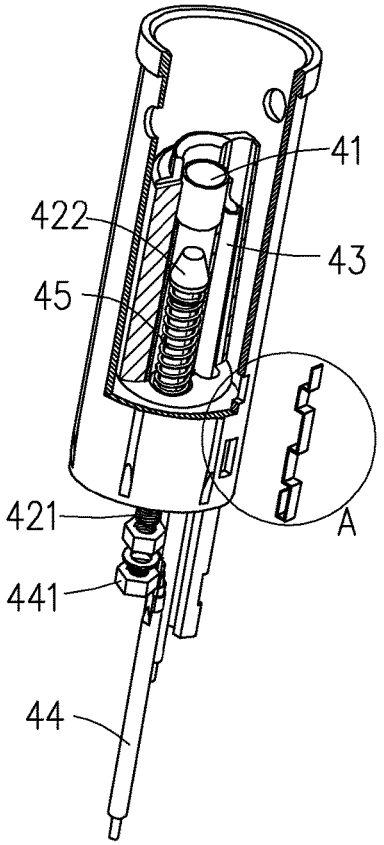
FIG. 6 is a partial cross-sectional view of the female connector of FIG. 4.

Please also referring to FIG. 5 and FIG. 6, the second support 22 includes a base plate 221 and a column 222. The peripheral side of the base plate 221 is connected to a tube wall (inner wall) of the receptacle tube 21, a first through hole 2211 is defined in the center of the base plate 221, and a fourth through hole 2212 is defined near the first through hole 2211. The column 222 extends upwardly from a center part of the base plate 221, defines a second through hole 2221 communicating with the first through hole 2211 and a third through hole 2222 wider than and communicating with the second through hole 2221. The first, second and third through holes 2212, 2221, 2222 are concentric and aligned an axle. That is, central axis of the second through hole 2221 are in one line and parallel with the vertical axis. A diameter of the third through hole 2222 is larger than that of the second through hole 2221, and the second through hole 2221 is between the first and the third through holes 2211, 2222.

Figure 7:
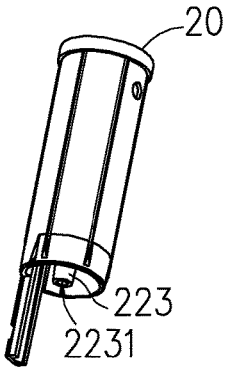
FIG. 7 is a perspective view of the receptacle tube and the second support.

In the embodiment, the column 222 further defines a fifth through hole 2223 communicating with the fourth through hole 2212 and parallel with the vertical axis and adjacent to the second through hole 2221. Please also referring to FIG. 7, the second support 22 further includes a second column 223 extending downwardly from the center part of the base plate 221. The second column 223 defines a sixth through hole 2231 communicating with the first through hole 2211 and being aligned in the vertical axis, and a diameter of the sixth through hole 2231 is smaller than that of the first through hole 2212.

The second electrical connector assembly 40 is mounted on the second support 22 and mainly includes a second electric conducting ring 41 electrically connected to a third electric wire 43, a second electric conducting rod 42 with one end electrically connected to a fourth electric wire 44 and a spring 45 sleeved on the second electric conducting rod 42. The second electric conducting ring 41 is a circular ring sized to fit into the third through hole 2222. That is, an external diameter of the ring 41 is substantially equal to an inner diameter of the third through hole 222 and is larger than that of the second through hole 2221, thus the ring 41 can be maintained within the second through hole 2222 tightly. An end of the third electric wire 43 is electrically connected to an outer surface of the ring 41, and the other end of the wire 43 passes through the fifth through hole 2223 and the fourth through hole 2212 and extends dowardly.

A part (including a first end) of the second electric conducting rod 42 has external thread 421, and the other end includes a boss 422 with a larger diameter than the other part of the rod 42. The fourth electric wire 44 is electrically connected to one or two nuts 441. The one or two nuts 441 are screwed with the external thread 421 of the second electric conducting rod 42 from an outside of the second support 22. The boss 422 is received in the second through hole 2221 or the second electric conducting ring 41 without touch of the ring 41. The spring 45 sleeved on the second electric conducting rod 42 is restrict between the bass 422 and the base plate 221 or the second column 223.

The part of the rod 42, received in the second column 223, is sized to fit into the sixth through hole 2231, thus a transverse movement is restricted. A diameter of the spring 45 is sized to fit into the second through hole 2221 (and the first through hole 2211) and is larger than the sixth through hole 2231, thus a vertical movement of the rod 32 is also limited.

Figure 8:
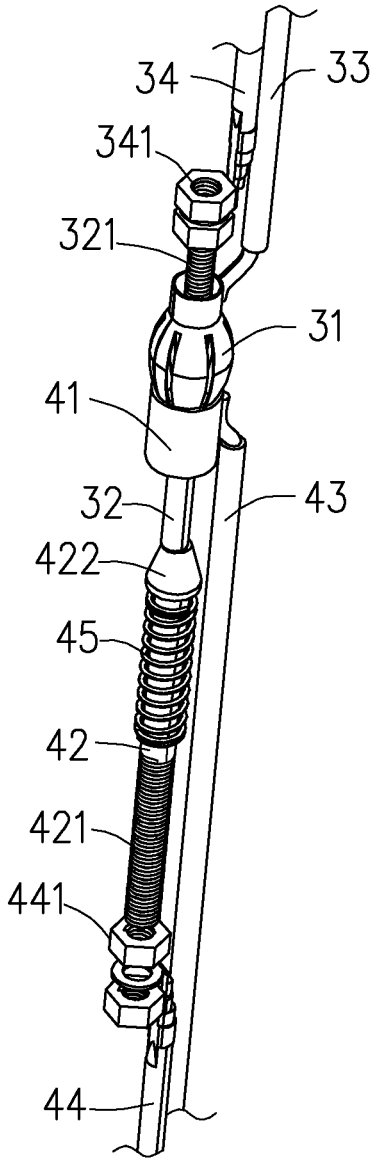
FIG. 8 is a perspective view of the first and the second electric assemblies.

Furthermore, an inner size of the receptacle tube 21 and an outer size of the second support 22 are such designed that the flange 111 (the first end) of the plug tube 11 is clamped tightly between a tube wall of the receptacle tube 21 and the second support 22 when the plug tube 11 of the male connector is inserted in the receptacle tube 21 of the female connector, and the second electric conducting ring 41 is partly sleeved on and electrically coupled with the first electric conducting ring 31, and the second electric conducting rod 42 is pressed against and electrically coupled with the first electric conducting rod 32, as illustrated in FIG. 8. Therefore, depending on the flange 111, the supporting assemblies 10 and 20 are capable of mechanically coupled together tightly and hardly to be separated without external force. Thus, a stability of the electrical and mechanical connections between the male connector and the female connector (adjacent trunk portions of the artificial tree) can be insured.

Furthermore, the receptacle tube 21 defines two fixing holes 212, 213 in its side wall, and the two fixing holes 212 and 213 are located at the two side of base plate 221, respectively. In the embodiment, the fixing hole 212 faces the column 222, and the fixing hole 213 faces the second column 223.

Figure 9:
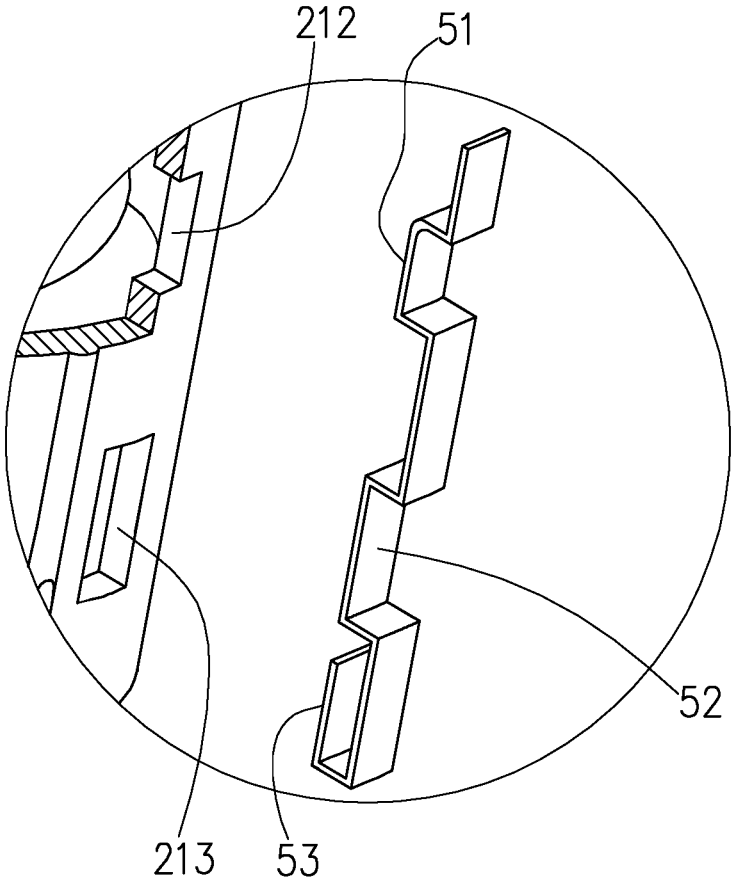
FIG. 9 is an enlarged view of a part A of FIG. 6.

The elastic conductive metal sheet 50 is attached to the outside surface of the side wall of the receptacle tube 21 and electrically connects to the inner wall of the trunk portion 84 when the trunk portion 84 is sleeved on the receptacle tube 21. The metal sheet 50 includes two arch parts 51, 52 (see FIG. 9) inserted in the fixing holes 212, 213 respectively and protruding out of the inner wall of the receptacle tube 21. The elastic conductive metal sheet 50 further includes a hook 53 to hook on to the lower end of the receptacle tube 21. When the lower end of the plug tube 11 is inserted in the receptacle tube 21, the flange 113 moves to a lower position than of the fixing hole 212 and is clamped between the receptacle tube 21 and the column 222, and the ring 13 which contacts with and is electrically connected to the lower end of the trunk portion 82 electrically contacts with the arch part 51 which inserts in the fixing hole 212 and protrudes out of the inner wall of the receptacle tube 21. Therefore, the trunk portions 82, 84 are electrically connected via the ring 13 and the sheet 50 and can be grounded when the trunk portions 82, 84 are mechanically connected via the male connector and the female connector.

In detail, the elastic conductive metal sheet 50 extends along the outside surface of the receptacle tube 21 from an upper side (first end) towards a lower side (second end), then bends towards the inner side of the receptacle tube 21 to insert in the fixing hole 212, then bends to extend downward again, then bends toward the outside of the receptacle tube 21 to extend out of the fixing hole 212, thus the arch part 51 is formed. Similar to the arch part 51, the arch part 52 is formed at a lower side of the arch part 51. Then the metal sheet 50 extends downwards again along the outer surface of the receptacle tube 21, bends to around the lower edge of the receptacle tube 21 and extends along the inner surface of the receptacle tube 21 to form the hook 53. The end of the metal sheet 50 is close to the fixing hole 213.

In assembly, clamping/hooking the hook 53 to the lower edge of the receptacle tube 21 firstly, then inserting the arch parts 51, 52 into the fixing holes 212, 213 to finish the assembly. It is understandably, the arch parts 51, 52 are sized to fit into the fixing holes 212, 213, such that the receptacle tube 21 can maintain the metal sheet 50 in place.

As the receptacle tube 21 can be sized to fit into an end of the trunk portion (such as the trunk portion 84), and the plug tube 11 can also be sized to fit into an end of another trunk portion (such as the trunk portion 82), there is no need for clamping pins to secure the male and female connectors to the trunks. As the male and the female connectors can be connected so tightly depending on the flange, there is no need to fix adjacent trunk portions tightly, the end with the male connector mounted of the trunk portion can only be sleeved on the end with the female connector mounted of another trunk portion.

The male connector only includes two electrical connecting elements (the ring 31 and the rod 32) and two supporting pieces (the tube 11 and the support 12), and the female connector only includes two electrical connecting elements (the ring 41 and the rod 42) and one or two supporting pieces (the tube 21 and the support 22 may be integrated in one piece). Therefore a structure of the electric connector is simple and easy to manufacture and assembly.

In the embodiment, the diameter of the first through hole 2211 may be equal to that of the second through hole 2221 because of the existence of the second column 223, it is understandably, the diameter of the first through hole 2211 may be smaller than that of the second through hole 2221 in other embodiments, thus the spring 45 can be restricted between the boss 422 and the base plate 221, and the second column 223 can be omitted.

In the embodiment, the column 22 defines fifth through hole 2223 to receive the third electric wire 43, it is understandably, a line slot may be defined in the outside wall of the column 22 and used to receive the third electric wire 43 in other embodiments.

In the embodiment, the flange 111 (the first end) of the plug tube 11 is clamped tightly between a tube wall of the receptacle tube 21 and the second support 22 when the plug tube 11 of the male connector is inserted in the receptacle tube 21 of the female connector. It is understandably, in other embodiments, an outer size of the flange 111 may be slightly larger than an inner diameter of the receptacle tube 21. As a result, the flange 111 (the first end) of the plug tube 11 can be hold tightly by the tube wall of the receptacle tube 21 when the plug tube 11 of the male connector is inserted in the receptacle tube 21 of the female connector. Thus, the stability of the electrical and mechanical connections between the male connector and the female connector (adjacent trunk portions of the artificial tree) can also be insured.

Figure 4:
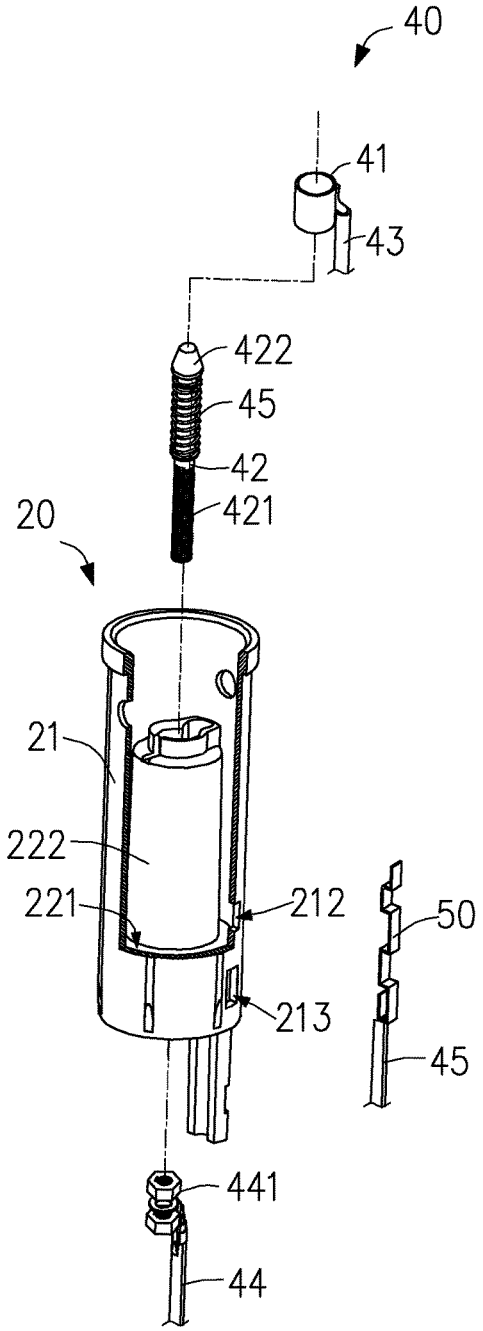
FIG. 4 is an exploded view illustrating a female connector, including the receptacle tube, a second support and a second electrical connector assembly, of the electric connector in accordance with an embodiment of the invention.

It is understandably, the first and the second electric wires 33, 34 may be respectively connected electrically to electric wires of another female connector mounted in the other end of the trunk portion, and may also be respectively connected electrically to a positive end and a negative end of a wall outlet which is partly exposed out of the trunk portion. The wall outlet may be used to electrically connected to the light strings those are distributed about the exterior of the tree. Similarly, the third and the fourth electric wires 43, 44 may be respectively connected electrically to electric wires of another male connector mounted in the other end of the trunk portion, and may also be respectively connected electrically to a positive end and a negative end of a power plug or a wall outlet which is partly exposed out of the trunk portion. The ring 13 contacts with and is electrically connected to the upper end of the trunk portion 82. The metal sheet 50 contacts with and is electrically connected to the inner wall of the trunk portion 84. The metal sheet 50 in the female connector which is installed in the lowest trunk portion may be connected electrically to a ground end (ground lead/end) of a power plug or a wall outlet via an electric wire 45 (FIG. 4).

In the embodiment, the elastic conductive metal sheet 50 is attached to the outer surface of the receptacle tube 21, and the arch parts 51, 52 insert into the fixing holes 212, 213 from the outside of the receptacle tube 21, such the ring 13 electrically contacts with the arch part 51. Thus the lower end of the trunk portion 82 which contact with the ring 13 is electrically connected to the trunk portion 84 via the ring 13 and the metal sheet 50. As the metal sheet 50 is grounded, all the trunk portion 82 is grounded.

In the other embodiment, the elastic conductive metal sheet 50 may be attached to the inner surface of the receptacle tube 21, and the arch parts 51, 52 insert into the fixing holes 212, 213 from the inner side of the receptacle tube 21, such the lower end of the trunk portion 82 electrically contacts with the straight-extending part of the metal sheet 50, and the arch parts 51, 52 may electrically contacts with the trunk portion 84. In other embodiment, the fixing hole 213 can be omitted.

In other embodiment, portions other than the flange 113 of the plug tube 11 may be sized to fit into the ring 13, and an upper part of the ring may be sized to fit into the trunk portion 82, therefore the upper part of the ring 13 is received in and contacts with the inner wall of the trunk portion 82 and is electrically connected to the trunk portion. The outer diameters of the flange 113, a lower part of the ring 13 and the trunk portion 82 are the same.

Figure 10:
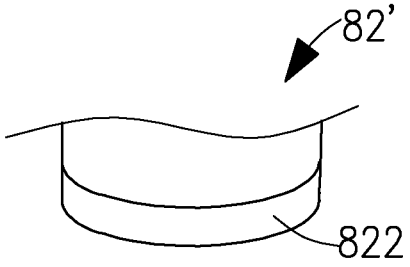
FIG. 10 is a perspective view of a lower end of the trunk portion in accordance with another embodiment of the invention.

Please refer to FIG. 10, in other embodiments, the ring 13 is omitted, and an outer surface of each lower end of the trunk portions 82' those have a male connector installed therein may include an electrical conductive area 822. In the embodiment, the outer surface of each lower end of the trunk portions 82 defines an annular electrical conductive area 822 around the lower end, an insulating paint layer does not covers the annular electrical conductive area 822. When the lower end of the plug tube 11 is inserted in the receptacle tube 21, the flange 113 moves to a lower position than of the fixing hole 212 and is clamped between the receptacle tube 21 and the column 222, and the electrical conductive area 822 electrically contacts with the arch part 51 which inserts in the fixing hole 212 and protrudes out of the inner wall of the receptacle tube 21. Therefore, the trunk portions 82, 84 are electrically connected and grounded when the trunk portions 82, 84 are mechanically connected via the male connector and the female connector.

While the invention has been described in terms of several exemplary embodiments, those skilled on the art will recognize that the invention can be practiced with modification within the spirit and scope of the appended claims. In addition, it is noted that, the Applicant's intent is to encompass equivalents of all claim elements, even if amended later during prosecution.

What is claimed is:

1. An electric connector for an artificial tree, the electric connector comprising:

a male connector capable of being received in an end of a first trunk portion of the artificial tree, comprising:

a plug tube;

a first support received in the plug tube; and a first electrical connector assembly mounted on the first support;

a female connector capable of being received in an end of a second trunk portion of the artificial tree, comprising:

a receptacle tube defining a fixing hole in its side wall;

a second support received in the receptacle tube;

a second electrical connector assembly mounted on the second support; and an elastic conductive metal sheet attached to the receptacle tube and configured to electrically connected to an inner wall of the second trunk portion;

wherein a first end of the plug tube comprises a flange extending outwardly and when the end of the first trunk portion is sleeved on the plug tube the flange protrudes out of the end of the first trunk portion;

wherein when the first end of the plug tube is inserted in the receptacle tube with the flange being clamped between the receptacle tube and the second support, the first electrical connector assembly is electrically coupled to the second electrical connector assembly, and the end of the first trunk portion sleeved on the plug tube is electrically connected with the elastic conductive metal sheet.

2. The electric connector of claim 1, wherein the elastic conductive metal sheet comprises an arch part inserted in the fixing hole of the receptacle tube to expose at another side of the fixing hole.

3. The electric connector of claim 2, wherein the male connector further comprises an electrical conductive metal ring sleeved on the plug tube and configured for contacting with and electrically connected with the first trunk portion; when the first end of the plug tube is inserted in the receptacle tube with the flange being clamped between the receptacle tube and the second support, the electrical conductive metal ring contacts with and electrically connects with the elastic conductive metal sheet.

4. The electric connector of claim 3, wherein the second support comprises:

a base plate with its peripheral side connecting to an inner wall of the receptacle tube; and a column extending substantially perpendicularly from a center part of the base plate;

wherein the fixing hole is defined at a first side of the base plate where the column extend from;

when the first end of the plug tube is inserted in the receptacle tube, the flange is clamped between the receptacle tube and the column, and the end of the first trunk portion sleeved on the plug tube electrically contacts with the arch part which inserts in the fixing hole and protrudes out of the inner wall of the receptacle tube.

5. The electric connector of claim 4, wherein the receptacle tube further defines a second fixing hole in its side wall at a second side opposite to the first side of the base plate; the elastic conductive metal sheet further comprises a second arch part and a hook; the second arch part is inserted in the second fixing hole of the receptacle tube and protrudes out of the inner wall of the receptacle tube; the hook hooks on to an end of the receptacle tube.

6. The electric connector of claim 4, wherein an internal flange extends inwardly from a tube wall of the plug tube to divide an inner space of the plug tube to a first receiving space and a second receiving space; the first support comprises a cylinder cup received in the first receiving space and a mounting tube extending downwardly from a bottom of the cylinder cup; the mounting tube passes through a center opening defined by the internal flange and located in the second receiving space.

7. The electric connector of claim 6, wherein the first electrical connector assembly comprises:

a first electric conducting ring at least a part of which is sleeved on the mounting tube and electrically connected to a first electric wire; and a first electric conducting rod with one end electrically connected to a second electric wire and the other end passing through the mounting tube from the cylinder cup and exposed out of the mounting tube and the first electric conducting ring.

8. The electric connector of claim 7, wherein a line slot is defined in the outer wall of the cylinder cup and is configured for receiving the first electric wire, and a middle part of the first electric conducting ring is resilient and expanded with respect to two ends of the first electric conducting ring.

9. The electric connector of claim 8, wherein the base plate defines a first through and a fourth through hole near the first through hole; the column defines a second through hole communicating with the first through hole and a third through hole wider than and communicating with the second through hole; the first, the second and the third through holes are concentric and the second through hole is between the first and the third through holes.

10. The electric connector of claim 9, wherein the second electrical connector assembly comprises:

a second electric conducting ring received in the third through hole and electrically connected to a third electric wire;

a second electric conducting rod with one end comprising a boss received in the second through hole or the second electric conducting ring without touch with the second electric conducting ring, and with the other end electrically connected to a fourth electric wire from an outside of the second support and the other end; and a spring sleeved on the second electric conducting rod and is restrict between the bass and the base plate of the second support;

wherein the second electric conducting ring partly sleeved on and electrically coupled with the first electric conducting ring, and the second electric conducting rod is pressed against and electrically coupled with the first electric conducting rod once the plug tube is inserted in the receptacle tube with the flange of the plug tube being clamped tightly between the receptacle tube and the second support;

wherein the column defines a fifth through hole communicating with the fourth through hole and configured for receiving the third electric wire; a line slot is defined in an outer wall of the column and is configured for receiving the third electric wire;

the second support further comprises a second column extending from the center part of the base plate towards a second end of the receptacle tube, the second column defines a sixth through hole communicating with the first through hole and configured for receiving a part of the second electric conducting rod.

11. An electric connector for an artificial tree, the electric connector comprising:

a male connector capable of being received in an end of a first trunk portion of the artificial tree, comprising:

a plug tube;

a first support received in the plug tube; and a first electrical connector assembly mounted on the first support;

a female connector capable of being received in an end of a second trunk portion of the artificial tree, comprising:

a receptacle tube defining a fixing hole in its side wall;

a second support received in the receptacle tube;

a second electrical connector assembly mounted on the second support; and an elastic conductive metal sheet attached to the receptacle tube and configured to electrically connected to the second trunk portion;

wherein a first end of the plug tube comprises a flange extending outwardly and when the end of the first trunk portion is sleeved on the plug tube the flange protrudes out of the end of the first trunk portion;

wherein when the first end of the plug tube is inserted in the receptacle tube with the flange and an inner wall of the receptacle tube interference fitted, the first electrical connector assembly is electrically coupled with the second electrical connector assembly, and the end of the first trunk portion sleeved on the plug tube is electrically connected with the elastic conductive metal sheet.

12. The electric connector of claim 11, wherein the elastic conductive metal sheet comprises an arch part inserted in the fixing hole of the receptacle tube to expose at another side of the fixing hole.

13. The electric connector of claim 12, wherein the male connector further comprises an electrical conductive metal ring sleeved on the plug tube and configured for contacting with and electrically connected with the first trunk portion; when the first end of the plug tube is inserted in the receptacle tube with the flange being clamped between the receptacle tube and the second support, the electrical conductive metal ring contacts with and electrically connects with the elastic conductive metal sheet.

14. The electric connector of claim 13, wherein the second support comprises:

a base plate with its peripheral side connecting to an inner wall of the receptacle tube; and a column extending substantially perpendicularly from a center part of the base plate;

wherein the fixing hole is defined at a first side of the base plate where the column extend from;

when the first end of the plug tube is inserted in the receptacle tube, the flange is clamped between the receptacle tube and the column, and the end of the first trunk portion sleeved on the plug tube electrically contacts with the arch part which inserts in the fixing hole and protrudes out of the inner wall of the receptacle tube.

15. The electric connector of claim 14, wherein the receptacle tube further defines a second fixing hole in its side wall at a second side opposite to the first side of the base plate; the elastic conductive metal sheet further comprises a second arch part and a hook; the second arch part is inserted in the second fixing hole of the receptacle tube and protrudes out of the inner wall of the receptacle tube; the hook hooks on to an end of the receptacle tube.

16. The electric connector of claim 14, wherein an internal flange extends inwardly from a tube wall of the plug tube to divide an inner space of the plug tube to a first receiving space and a second receiving space; the first support comprises a cylinder cup received in the first receiving space and a mounting tube extending downwardly from a bottom of the cylinder cup; the mounting tube passes through a center opening defined by the internal flange and located in the second receiving space.

17. The electric connector of claim 16, wherein the first electrical connector assembly comprises:

a first electric conducting ring at least a part of which is sleeved on the mounting tube and electrically connected to a first electric wire; and a first electric conducting rod with one end electrically connected to a second electric wire and the other end passing through the mounting tube from the cylinder cup and exposed out of the mounting tube and the first electric conducting ring.

18. The electric connector of claim 17, wherein a line slot is defined in the outer wall of the cylinder cup and is configured for receiving the first electric wire, and a middle part of the first electric conducting ring is resilient and expanded with respect to two ends of the first electric conducting ring.

19. The electric connector of claim 18, wherein the base plate defines a first through and a fourth through hole near the first through hole; the column defines a second through hole communicating with the first through hole and a third through hole wider than and communicating with the second through hole; the first, the second and the third through holes are concentric and the second through hole is between the first and the third through holes.

20. The electric connector of claim 19, wherein the second electrical connector assembly comprises:

a second electric conducting ring received in the third through hole and electrically connected to a third electric wire;

a second electric conducting rod with one end comprising a boss received in the second through hole or the second electric conducting ring without touch with the second electric conducting ring, and with the other end electrically connected to a fourth electric wire from an outside of the second support and the other end; and a spring sleeved on the second electric conducting rod and is restrict between the bass and the base plate of the second support;

wherein the second electric conducting ring partly sleeved on and electrically coupled with the first electric conducting ring, and the second electric conducting rod is pressed against and electrically coupled with the first electric conducting rod once the plug tube is inserted in the receptacle tube with the flange of the plug tube being clamped tightly between the receptacle tube and the second support;

wherein the column defines a fifth through hole communicating with the fourth through hole and configured for receiving the third electric wire; a line slot is defined in an outer wall of the column and is configured for receiving the third electric wire;

the second support further comprises a second column extending from the center part of the base plate towards a second end of the receptacle tube, the second column defines a sixth through hole communicating with the first through hole and configured for receiving a part of the second electric conducting rod.

* * * * *